US006818873B2

(12) United States Patent
Savage et al.

(10) Patent No.: US 6,818,873 B2
(45) Date of Patent: Nov. 16, 2004

(54) PACKAGED FOOD PRODUCT

(76) Inventors: Sean Savage, 3 Athlumney Castle, Navan, Co. Meath (IE); Paul Baldwin, Scurff Hall Cottage, Rusholme, Drax, Selby, North Yorkshire (GB), Y08 8PW ( * ) Notice: Subject to any disclaimer, the term of this patent is extended or adjusted under 35 U.S.C. 154(b) by 91 days.

(21) Appl. No.: 10/236,582

(22) Filed: Sep. 6, 2002

(65) Prior Publication Data

US 2003/0071036 A1 Apr. 17, 2003

(30) Foreign Application Priority Data

Sep. 7, 2001 (GB) ..... 0121623

(51) Int. Cl.[7] ..... H05B 6/80
(52) U.S. Cl. ..... 219/730; 219/735
(58) Field of Search ..... 219/725, 728, 219/729, 730, 731, 734, 735; 99/DIG. 14; 426/107, 213, 234, 113; 53/428, 434, 440

(56) References Cited

U.S. PATENT DOCUMENTS

| | | | | | |
|---|---|---|---|---|---|
| 3,261,140 | A | * | 7/1966 | Long et al. | 53/428 |
| 4,013,798 | A | * | 3/1977 | Goltsos | 426/107 |
| 4,210,674 | A | | 7/1980 | Mitchell | 426/107 |
| 4,419,373 | A | * | 12/1983 | Oppermann | 426/234 |
| 4,641,005 | A | | 2/1987 | Seiferth | 219/10.55 E |
| 4,825,025 | A | | 4/1989 | Seiferth | 219/10.55 E |
| 4,865,854 | A | * | 9/1989 | Larson | 426/107 |
| 4,940,867 | A | | 7/1990 | Peleg | 219/10.55 |
| 5,044,777 | A | | 9/1991 | Watkins et al. | 383/100 |
| 5,247,149 | A | | 9/1993 | Peleg | 219/10.55 |
| 6,054,698 | A | * | 4/2000 | Mast | 219/730 |
| 6,137,099 | A | | 10/2000 | Hamblin | 219/730 |

FOREIGN PATENT DOCUMENTS

| | | |
|---|---|---|
| EP | 0 294 087 A2 | 12/1988 |
| EP | 0 357 331 A2 | 3/1990 |
| EP | 0 471 969 B1 | 2/1992 |
| EP | 0 839 737 A1 | 5/1998 |
| EP | 0 875 468 A1 | 11/1998 |
| EP | 1 190 960 A2 | 3/2002 |
| FR | 2 761 348 | 10/1998 |
| GB | 2 248 159 A | 3/1992 |
| GB | 2 368 507 A | 5/2002 |
| GB | 2 369 341 A | 5/2002 |
| JP | 10-95472 | 4/1998 |
| JP | 2000-25846 | 1/2000 |
| WO | 93/15976 | 8/1993 |

* cited by examiner

*Primary Examiner*—Tu Ba Hoang
(74) *Attorney, Agent, or Firm*—RatnerPrestia

(57) ABSTRACT

A packaged food product suitable for microwave heating includes a microwave susceptor and a sealed container that encloses the food product and the microwave susceptor. A gas is sealed within the container and the container has at least one releasably sealed opening that is adapted to vent gas from the package during heating. The susceptor is disposed adjacent the food product to shield at least a portion of the food product against microwave heating, whilst simultaneously heating the shielded portion by infrared radiation.

32 Claims, 2 Drawing Sheets

PACKAGED FOOD PRODUCT

FIELD OF THE INVENTION

The present invention relates to a packaged food product suitable for microwave heating, a method of heating a food product, and a method of packaging a food product.

BACKGROUND OF THE INVENTION

Over recent years the popularity of food items that may be stored in a refrigerator or freezer and subsequently transferred to a microwave oven for cooking or reheating has risen. Consumers prefer such food products to be provided in containers suitable both for storage in refrigerators or freezers and for heating the food product by subjecting it to microwave radiation. Such products may be purchased as chilled or frozen items that can be stored at home and subsequently heated in a microwave oven. Alternatively, such products may be purchased from vending machines comprising a refrigerated unit and a microwave oven unit.

For certain food products, in particular those such as soups and stews that have a high water content and a substantially uniform consistency, microwave heating presents no particular difficulty and generally produces satisfactory results. All the consumer has to do is to remove the packaged food product from the refrigerator, make one or two vent holes in the packaging and then heat it in a microwave oven for an appropriate time.

However, for other types of food product it is much more difficult to achieve an acceptable result. These include in particular food products that comprise two or more components having different consistencies, such as a hamburger sandwich comprising a meat patty in a split bread bun. The bread has a much lower water content than the meat patty and heats much more rapidly. Therefore, when the sandwich is heated sufficiently to raise the temperature of the patty to an acceptable level, excessive heating of the bread takes place. As a result, moisture is driven out of the bread and it becomes hard if it is heated without packaging, or the bread becomes soggy if it is heated while packaged, owing to condensation of moisture from the patty. The resulting product is of a poor and generally unacceptable quality.

Problems also arise in relation to other food products, such as those that need to develop a crust or that require a degree of browning, which cannot be achieved by the simple use of microwave heating.

Recently, the use of microwave susceptors has improved the quality of certain microwave food products, such as hand held snacks. Microwave susceptors are devices having an electrically conductive layer that is heated when exposed to microwave energy. The susceptor absorbs a portion of the microwave energy and converts it into heat, which can be used to crispen foodstuffs. Success requires the susceptor to heat faster than the food article to be heated. Continuous heating occurs until a maximum temperature (approximately 200° C.) is reached, and the susceptor behaves like a conventional oven up to this time. Thereafter, the susceptor begins to break down and becomes transparent to microwave energy. However, the use of a microwave susceptor alone has had only limited success owing to the required length of cooking time, which in turn causes overheating and hardening of the bread.

The use of a mixture of gases, usually $CO_2$ and $N_2$, in sealed hand-held snack packs to deliver extended shelf life has been known for a number of years. The process is usually referred to as "gas flushing", or C.A.P. (controlled atmosphere packing) or M.A.P. (modified atmosphere packing) and involves the evacuation of air from the pack, to inhibit the growth of aerobic pathogens, and replacing air with an inert gas mixture of $N_2$ and $CO_2$ which inhibits pathogen growth. This process can deliver a longer shelf live, for example up to 25 days for chilled hand-held products.

Various different kinds of packaging have been developed to allow different types of food product to be heated using microwaves. For example, U.S. Pat. No. 6,137,099 describes food packaging comprising a corrugated sheet of a susceptor material that is wrapped at least partially around a food product. During heating, the susceptor material absorbs some of the microwave energy and is heated, re-emitting that energy as infrared radiation to brown or crisp the food product.

EP0294087A describes a microwave food product comprising an elongate bag having a seal that opens during heating to allow vapours to vent from the bag. The bag is made from paper and includes a susceptor at a location where the bag will contact the floor of the microwave oven.

EP1190960A describes a packaging assembly for food products that is particularly suited for use in dispensing machines. The package has a paper inner wrapper and a plastic outer wrapper to preserve freshness, and includes a susceptor attached to the outer wrapper that heats to open the outer wrapper and assist in heating the food.

Although the packaging products described in the aforementioned patents improve the microwave heating of certain foods, we have found that they do not solve all the problems associated with other food products, in particular those comprising two or more components that have different consistencies and require different degrees of heating.

It is an object of the present invention to provide a packaged food product suitable for microwave heating, and a method of heating a food product, that mitigates at least some of the aforesaid problems. It is also desirable, although not essential, that the food package should be capable of preserving the food product and protecting it against contamination during handling and transportation, and that it should allow the food product to be heated with the minimum of preparation by the consumer.

According to the present invention there is provided a packaged food product suitable for microwave heating, the package including a microwave susceptor, a sealed container that encloses the food product and the microwave susceptor, and a gas sealed within the container, the container having at least one releasably sealed opening that is adapted to vent gas from the package during heating, the susceptor being disposed adjacent the food product to shield at least a portion of the food product against microwave heating, whilst simultaneously heating said portion by infrared radiation.

The susceptor is arranged to shield a portion of the food product that has a relatively low water content, to prevent over-heating of that portion of the product by microwave radiation. At the same time, the susceptor is heated by the absorbed microwave radiation and emits infrared radiation, which heats the adjacent portion of the food product. Another portion of the food product, which generally has a higher water content, is left substantially unshielded. The unshielded portion of the food product is heated by the microwave radiation, thereby ensuring that all the components of the food product are heated evenly. To achieve these aims effectively, the susceptor is located adjacent the portion of the food product that requires shielding/infrared heating.

The container is initially sealed, thereby protecting the food product against contamination. During heating, the container remains sealed initially, thereby containing the expanding gas and the steam emitted from the food product, and increasing the speed at which the product is heated. After a predetermined time, the container vents to release gas and steam from the package, to prevent the food product becoming soggy due to absorbed moisture.

We have found that this combination of a susceptor that is disposed adjacent the food product to shield at least a portion of the food product against microwave heating, whilst simultaneously heating said portion by infrared radiation, and a container that encloses the food product and the microwave susceptor and has at least one releasably sealed opening that vents gas from the package during heating is highly effective and produces excellent results when used for heating food products such as hamburger sandwiches that are normally extremely difficult to heat satisfactorily in a microwave oven.

Advantageously, the susceptor is adapted to remain in close proximity with the food product during heating. This solves a problem with certain previous food packages, in which the susceptor is part of the outer wrapper and therefore moves away from the food product as the container expands. In order to achieve a satisfactory result, we have found that it is highly desirable for the susceptor to remain in close proximity with the food product throughout the heating process. Preferably, the susceptor is separate from the container.

The susceptor advantageously covers at least the top and bottom of the food product, to shield those portions against microwave heating. The susceptor preferably partially or completely surrounds the food product. The susceptor may includes a tear strip to assist removal after heating. In one preferred embodiment, the susceptor comprises an open-ended sleeve that covers the top and bottom and the two sides of the food product.

Preferably, the susceptor comprises a metallised film on a microwaveable substrate. The microwaveable substrate preferably comprises a sheet of paper or card.

In a preferred embodiment, the container comprises a flexible wrapper. The wrapper may include a membrane, which may be either a single structure or a laminated/co-extruded combination of materials selected from a group including polyethylene, polystyrene, polypropylene, polyamide (nylon), polyester, polyolefin and cellulose based products such as cellophane. In one embodiment, the membrane has a laminar structure comprising an outer layer of orientated nylon laminated to an inner layer of polyethylene.

In another embodiment, the container comprises a tray with a removable lid.

Preferably, the container is substantially impermeable to the contained gas.

The releasably sealed opening may comprise a seam of the container. The releasably sealed opening is preferably adapted to vent gas from the package at a predetermined excess pressure. The releasably sealed opening may be sealed by heat crimping. The container may include a plurality of seams having different seal strengths, whereby the weaker seams are adapted to vent during heating whereas the stronger seams remain intact.

In one embodiment, the packaging comprises at least one releasably sealed opening and at least one sealed opening, wherein the releasably sealed opening is sealed at a first temperature and the sealed opening is sealed at a second, higher temperature. Preferably the first temperature is 165° C. and the second temperature 180° C.

Advantageously, the container is substantially transparent to microwave radiation. The container may be clear, so as to enable the food item to be visible during preparation.

Advantageously, the contained gas has preservative properties, to prolong the shelf life of the food product. The contained gas may be selected from a group of gases including one or a combination of nitrogen, carbon dioxide, argon, helium, oxygen, carbon monoxide or other gases. Preferably the gas comprises a combination of nitrogen and carbon dioxide.

The food product may include a plurality of components having different compositions, including a first component having a relatively low water content and a second component having a higher water content. The first component may be selected from a group including bread, pastry, batter and cereal-based products, and the second component may be selected from a group including meat, fruit, vegetables, sauces, eggs, cheese, milk, milk products and combinations thereof. The susceptor preferably covers at least a substantial portion of the first component, whilst leaving at least a substantial portion of the second component uncovered.

In accordance with a further aspect of the present invention there is provided a method of heating a packaged food product as defined by any one of the preceding statements of invention, the method comprising heating the packaged food product using microwave radiation for a predetermined combination of power and time settings, said combination of power and time settings being selected such that during a first part of the heating period the temperature and pressure of gas sealed within the container increases, and during a second part of the heating process the releasably sealed opening opens to vent gas from the container, and wherein the microwave susceptor shields at least a portion of the food product against microwave heating whilst simultaneously heating said portion by infrared radiation.

According to another aspect of the invention there is provided a method of packaging a food product, in which a food product and a microwave susceptor are placed in a container with the susceptor adjacent the food product, the container is flushed with gas of a controlled composition and the container is sealed to contain the gas, said container having at least one releasably sealed opening that is adapted to vent gas from the package during heating.

The susceptor may be positioned to cover at least the top and bottom of the food product. Advantageously, food product is placed in an open-ended susceptor sleeve, and the sleeved food product is placed in the container.

According to one preferred embodiment, the container comprises a flexible wrapper, and the container is sealed by heat crimping. The releasably sealed opening advantageously comprises a seam of the container.

Specific embodiments of the present invention will now be described by way of example, with reference to the following figures:

DETAILED DESCRIPTION OF THE INVENTION

Figure 1:
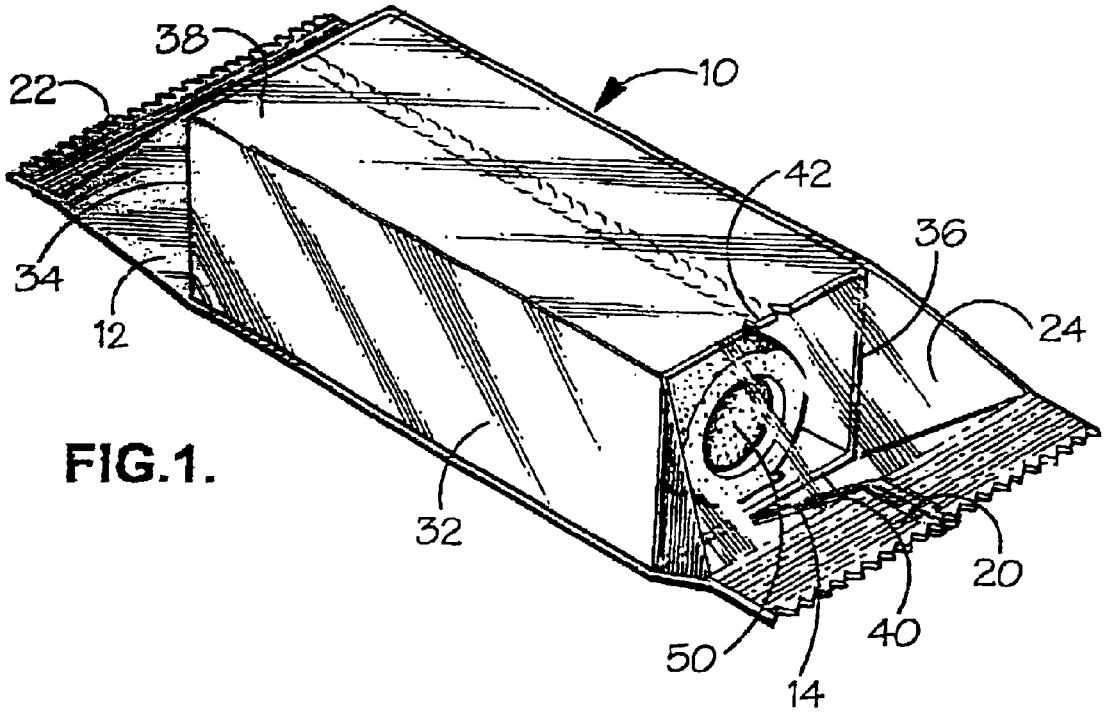
FIG. 1 is a perspective illustration of a packaged food item according to a first embodiment of the invention.

FIG. 1 illustrates a packaged food item 10 which includes an outer container or wrapper 12 comprising a rectangular sheet of transparent membrane whose longitudinal edges are sealed to one another by means of a longitudinal seal 14 to form an elongate flexible package. The ends 20,22 of the wrapper are releasably sealed to one another by heat sealing, forming an airtight cavity 24 within the wrapper.

Disposed within the cavity 24 is a microwave susceptor 32 in the form of an elongate sleeve having rectangular box cross section, comprising two substantially parallel planar elongate side walls 34,36 and upper and lower substantially planar elongate walls 38,40 which are perpendicular to the side walls 34, 36. The inner surface of the sleeve is metallised.

The upper wall 38 has a tear strip 42 centrally disposed which extends along its longitudinal axis. Disposed within the elongate body 32 is food item 50, which in this embodiment is a sausage roll (a sausage in a pastry case).

Figure 2:
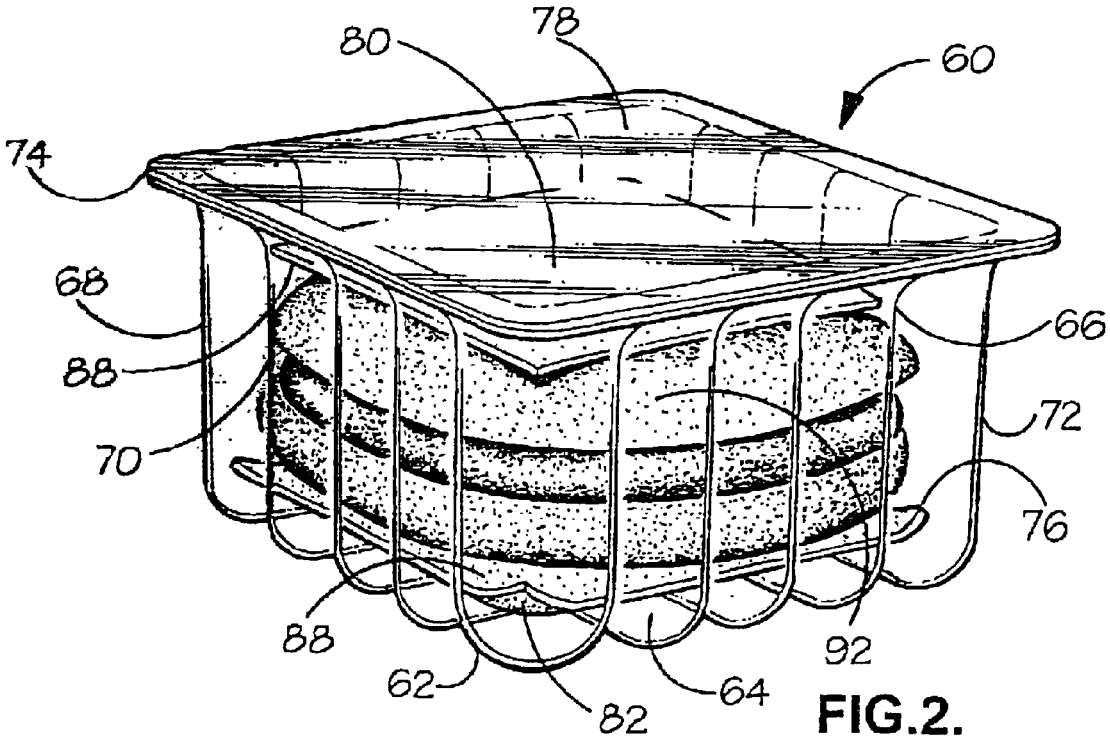
FIG. 2 is a perspective illustration of a packaged food item according to a second embodiment of the invention.

FIG. 2 illustrates a packaged food item according to a second embodiment of the invention, in which packaging 60 includes a container comprising a transparent microwaveable tray 62 having a substantially rectangular base 64, two substantially planar side walls 66,68 parallel to one another, and two substantially planar end walls 70,72 parallel to one another and perpendicular to the side walls 66,68. The open upper end of said tray has a flange 74 which extends around the perimeter.

A substantially rectangular transparent membrane 78 is releasably sealed to flange 74, forming an airtight cavity 76 within the tray 62.

Disposed within cavity 76 are two microwave susceptors 80,82 each of which has a substantially planar rectangular body and a metallised surface 88,90. Disposed between the susceptors 80,82 is a food item 92, which in this embodiment is a hamburger sandwich comprising a meat patty in a split bread bun. The susceptors 80, 82 are orientated such that the metallised surfaces 88,90 are adjacent to the food item 92.

Figure 3:
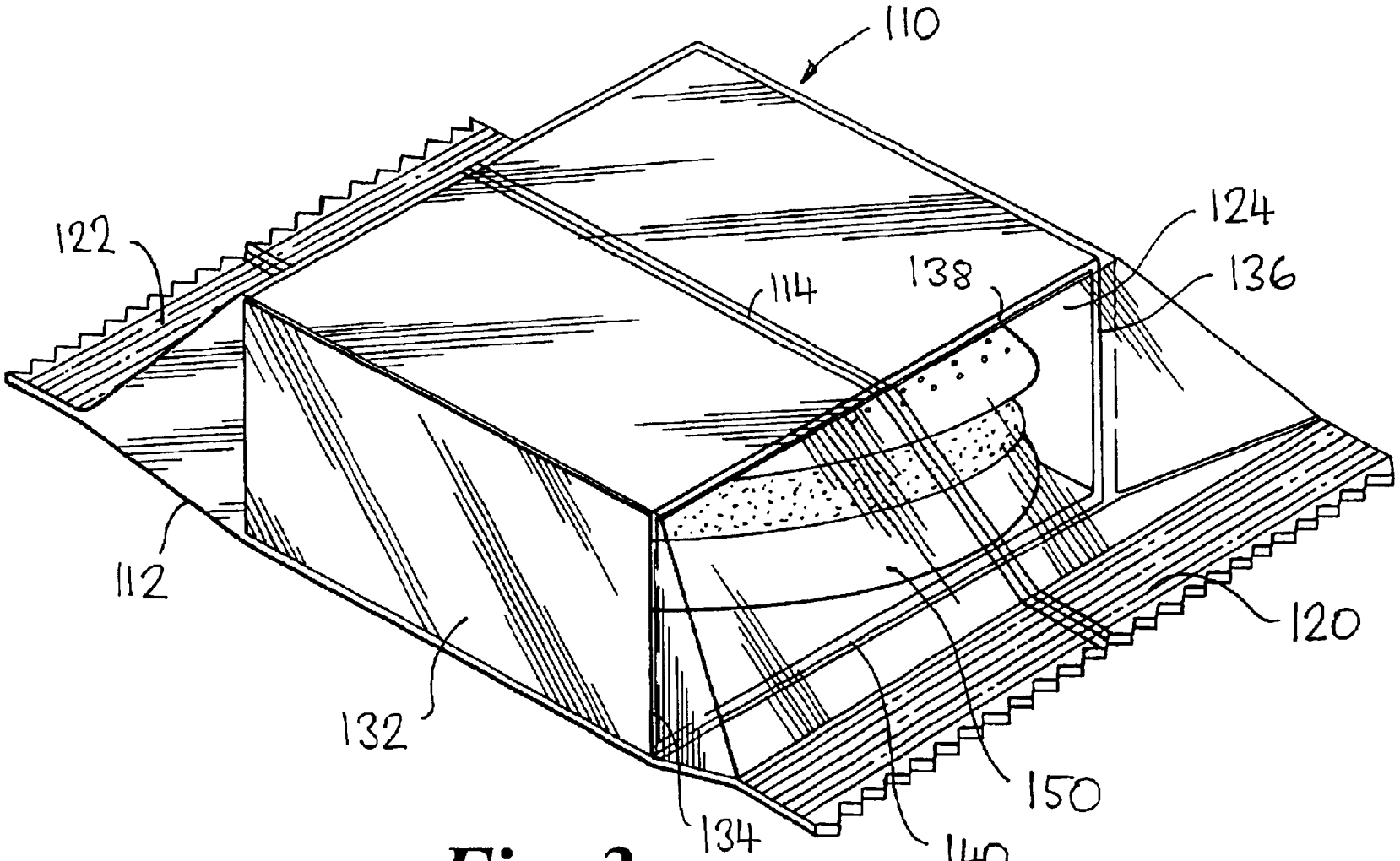
FIG. 3 is a perspective illustration of a packaged food item according to a third embodiment of the invention.

FIG. 3 illustrates a packaged food item according to a third embodiment of the invention, in which the package 110 includes an outer container or wrapper 112 comprising a rectangular sheet of transparent membrane whose longitudinal edges are sealed to one another by means of a longitudinal seal 114 to form an elongate flexible package. The ends 120,122 of the wrapper are releasably sealed to one another by heat sealing, forming an airtight cavity 124 within the wrapper.

Disposed within the cavity 124 is a microwave susceptor 132 in the form of an elongate sleeve having rectangular box cross section, comprising two parallel substantially planar elongate side walls 134,136 and upper and lower substantially planar elongate walls 138,140 which are perpendicular to side walls 134, 136.

Disposed within the elongate body 132 is food item 150, which in this embodiment is a hamburger sandwich comprising a meat patty in a split bread bun.

Examples of the materials used for the susceptor and the container in each of the above embodiments are set out below.

The Susceptor

The susceptor preferably comprises a laminate of susceptor film on a card or paper substrate. The susceptor film may be made of polyester that is vacuum metallised with aluminium. It is laminated onto the substrate using a water based adhesive with the metal deposit between the polyester and the substrate.

The Container

In the embodiments shown in FIGS. 1 and 3, the container comprises a wrapper made of a flexible membrane. The membrane may be either a single structure or a laminated/co-extruded combination of materials selected from a group including polyethylene, polystyrene, polypropylene, polyamide (nylon), polyester, polyolefin and cellulose based products such as cellophane. Some examples of suitable materials are set out below:

Example 1

PAO/PEHPC 60

The membrane has a thickness of 60 $\mu$m and comprises an outer layer of biaxially oriented polyamide laminated to an inner peelable sealing layer of polyethylene. Characteristics of the film are good transparency, a broad sealing range, a medium oxygen barrier and good mechanical behaviour. The membrane can be printed using the flexogravure process.

Example 2

PET/PEHPC 60

The membrane has a thickness of 60 $\mu$m and comprises an outer layer of biaxially oriented polyester laminated to an inner peelable sealing layer of polyethylene. Characteristics of the film are good transparency, a broad sealing range, a low to medium oxygen barrier and good mechanical behaviour. The membrane can be coloured or printed using the flexogravure process. Pasteurization is possible.

Example 3

PAO/PP-P 65

The membrane has a thickness of 65 $\mu$m and comprises an outer layer of polyamide laminated to an inner peelable sealing layer of polypropylene. Characteristics of the film are good transparency, a broad sealing range and good mechanical behaviour. The membrane can be printed using the flexogravure process.

In the embodiments shown in FIG. 2, the container comprises a transparent microwaveable tray, which may be made for example from a material such as that sold by S üdpack UK limited under the trade name Ecoterm SV 350 T. The transparent membrane 78 that is releasably sealed to the tray may for example be made of one of the materials described in examples 1 to 3 above.

The Atmosphere

The gas sealed within the container is preferably a modified atmosphere that provides preservative properties and controls the venting of the container during the heating process. The contained gas may be selected from a group of gases including one or a combination of nitrogen, carbon dioxide, argon, helium, oxygen, carbon monoxide or other gases. Preferably the gas comprises a combination of nitrogen (10%) and carbon dioxide (90%).

Assembly and Packaging

In the embodiment shown in FIG. 3, the food item 150 is a hamburger sandwich comprising a meat patty in a split bun. The sandwich is placed in a microwave susceptor sleeve 116 and the assembled sleeved sandwich is then flow wrapped in a microwaveable film. During the flow packaging process, air is expelled from the pack by pressure flush displacement and replaced with a modified atmosphere with a gas composition of 90% $CO_2$ and 10% $N_2$. The packaging is heat sealed at both open ends 120,122 at a first, lower temperature of 165° C. and at its longitudinal edges 114 at a second, higher temperature of 180° C.

A similar process is used for assembly of the first food package shown in FIG. 1.

In the embodiment shown in FIG. 2, a microwaveable tray is formed by a moulding and vacuum-forming process. A susceptor card is placed on the base of the pre-formed tray with the metallised surface facing upwards. The beef burger patty in split bun is placed into the pre-formed tray on top of the susceptor card. A further susceptor card is placed on top of the bun with metallised side downwards. Air is evacuated from the tray and replaced with a mixture of carbon dioxide and nitrogen (90/10). A layer of microwaveable film is then heat sealed at a temperature of 165° C. on to the tray to form a lid.

Cooking Process for Chilled Food Items

By way of example, the preparation of a hamburger sandwich shall be described. It will be apparent, however, to the skilled person that other food items can be similarly prepared. The assembled, wrapped, gas flushed sandwich is placed in a microwave oven. Typically, for a 100 g burger, the wattage control is set a 800W and the timer set for 90 seconds.

During the first 20 seconds the microwave energy rapidly heats the meat patty through the open ends of the susceptor sleeve and expands the gas mixture, increasing the pressure in the container and generating steam. This creates an effect similar to a pressure cooker or turbo oven, which in turn accelerates the rise in cooking temperature. The outer container expands with the increasing gas pressure, but the susceptor sleeve remains in close contact with the food product. The bread component is therefore protected from the microwave radiation by the susceptor sleeve, which is heated by the absorbed microwave radiation and starts to warm the bread by conduction and radiant to heating (i.e. infrared radiation).

After about 20 seconds, the pack seal vents in response to the increasing pressure, thereby releasing the gas and steam mixture and ensuring that the bread component does not become soggy. At this stage, the beef burger patty will have reached a temperature of approximately 35° C. During the remaining 70 seconds of cooking time, microwave heating of the meat patty continues to a temperature of 70° C. The susceptor will by this time have reached a temperature of about 200° C., at which temperature the metallised film starts to break down and becomes partially transparent to the microwave radiation. It therefore continues to heat the bread component with a combination of microwave energy and radiant heat. For a special toasted finish product, the cooking time can be extended by a further 10 seconds.

Cooking Process for Frozen Food Item

By way of example, a beef burger patty in a bun shall again be described. The assembly configuration for a frozen item e.g. beef burger patty and bun is different. The burger patty is placed on top with the cheese slice and the split bun underneath. This allows for more rapid heating of the meat component. The assembled, wrapped, gas flushed frozen sandwich is placed in the microwave oven. The control is set for 800W and the timer is set for 90 seconds. During the first 40 seconds the pack contents thaw and at the same time, the microwave energy rapidly expands the gas mixture increasing pressure and generating steam which operates a similar effect to a pressure cooker or turbo oven, which in turn accelerates the rise in cooking temperature. In the meantime the bread is protected from the microwave energy by the susceptor sleeve, which in effect is acting as a shielding device, since the susceptor material has not yet reached the level of temperature (approximately 200° C.) at which it becomes transparent to microwave energy. The pack vents at 40 seconds, this is 20 seconds slower than the chilled product owing to the time taken for the temperature to increase from frozen (−18° C.) to chilled (+5° C.).

The heating process may be carried out automatically in a vending machine including a chilled compartment containing a variety of chilled food products and a microwave heating compartment. The user inserts the appropriate money and selects one of the food products, which is transferred automatically from the chilled compartment to the heating compartment. The product is heated for a predetermined time (for example 40s) and then dispensed hot to the user.

The present invention is suitable for use with a wide range of food products, some examples of which are listed below:

1. Any bread based product which is sandwich style filled e.g.:
   - Veggie Burger in Bun
   - Beef Burger in Bun
   - Hot Dog Roll
   - Bacon & Sausage Roll
   - Steak Sandwich, etc.
   - Any variation of the above with any filing.
2. Pastry based products e.g.:
   - Sausage Rolls
   - Cornish Pasty
   - Filled Pastry Slice
   - Spring Rolls
   - Apple Tart, etc
   - Any variation of the above with filling sweet or savoury.
3. Conventional Toasted Sandwiches with any filling. 4. Ethnic Range e.g.:
   - Samosas
   - Bajhis
   - Doner Kebabs, etc.
5. Garlic Bread
6. Any Continental style bread which is sandwich filled (toasted or plain) e.g.:
   - Pannini
   - Ciabiatta
   - Focaccia
   - Croissants, etc.
   - Any variation with any filling.
7. Yorkshire Pudding—filled or unfilled
8. Sponge based products—filled or unfilled (sweet or savoury)
9. Wraps, Tortillas and Fajitas with any filling
10. Pancakes with any fillings (sweet or savoury)
11. Vol-an-vents with any fillings (sweet or savoury)
12. Any meat or processed meat products prepared separately e.g.:
    - Beef Burgers
    - Chicken Fillets
    - Sausages
    - Bacon
    - Veggie Burger
    - Steak
    - Lamb Chop
    - Pork Chop, etc.
13. Range of "Roasted" vegetables e.g.:
    - Carrots
    - Parsnips
    - Peppers
    - Potatoes, etc.

14. Waffles with or without fillings
15. Range of Pizza Slices with various toppings
16. Range of Quiches with various fillings The above list is not exhaustive. The products may be fresh, chilled or frozen.

What is claimed is:

1. A packaged food product suitable for microwave heating, the packaged food product including a microwave susceptor, a sealed container that encloses the food product and the microwave susceptor, and a gas sealed within the container, the container having at least one releasably sealed opening that is adapted to open during heating to vent gas from the packaged food product, the susceptor being disposed adjacent the food product to shield at least a portion of the food product against microwave radiation, whilst simultaneously heating said portion by infrared radiation, wherein the susceptor covers more than one surface of the food product and is separate from and is not secured to the container and is adapted to remain in close proximity with the food product during heating.

2. A packaged food product according to claim 1, in which the susceptor covers at least the top and bottom of the food product.

3. A packaged food product according to claim 1, in which the susceptor partially or completely surrounds the food product.

4. A packaged food product according to claim 3, in which the susceptor includes a tear strip.

5. A packaged food product according to claim 3, in which the susceptor comprises an open-ended sleeve that covers the top and bottom and two sides of the food product.

6. A packaged food product according to claim 3, in which the susceptor comprises a metallised film on a microwaveable substrate.

7. A packaged rood product according to claim 6, in which the microwaveable substrate comprises a sheet of paper or card.

8. A packaged food product according to claim 5, in which the container comprises a flexible wrapper.

9. A packaged rood product according to claim 8, in which the wrapper includes a membrane having a laminar structure.

10. A packaged food product according to claim 9, in which the membrane comprises either a single structure or a laminated/co-extruded combination of materials selected from a group including polyethylene, polystyrene, polypropylene, polyamide, polyester, polyolefin and cellulose based products.

11. A packaged food product according to claim 9, in which the membrane has a laminar structure comprising an outer layer of orientated nylon laminated to an inner layer of polyethylene.

12. A packaged food product according to claim 1, in which the container comprises a tray with a removable lid.

13. A packaged food product according to claim 1, in which the container is substantially impermeable to the sealed gas.

14. A packaged food product according to claim 1, in which the releasably sealed opening comprises a seam of the container.

15. A packaged food product according to claim 1, in which the releasably sealed opening is adapted to vent gas from the packaged food product at a predetermined excess pressure.

16. A packaged food product according to claim 1, in which the releasably sealed opening is sealed by heat crimping.

17. A packaged food product according to claim 16, in which the container includes a plurality of seams having different seal strengths.

18. A packaged food product according to claim 1, in which the container is substantially transparent to microwave radiation.

19. A packaged food product according to claim 1, in which the sealed gas has preservative properties.

20. A packaged food product according to claim 19, in which the sealed gas is selected from a group of gases including one or a combination of nitrogen, carbon dioxide, argon, helium, oxygen and carbon monoxide.

21. A packaged food product according to claim 1, in which the food product includes a plurality of components having different compositions, including a first component having a relatively low water content and a second component having a higher water content.

22. A packaged food product according to claim 21, in which the first component is selected from a group including bread, pastry, batter and cereal-based products, and the second component is selected from a group including meat, fruit, vegetables, sauces, eggs, cheese, milk, milk products and combinations thereof.

23. A packaged food product according to claim 21, in which the susceptor covers at least a substantial portion of the first component, whilst leaving at least a substantial portion of the second component uncovered.

24. A method of heating a packaged food product according to claim 1, the method comprising heating the packaged food product using microwave radiation for a predetermined combination of power and time settings, said combination of power and time settings being selected such that during a first part of the heating period the temperature and pressure of gas sealed within the container increases, and during a second part of the heating process the releasably sealed opening opens to release gas and steam from the container, and wherein the microwave susceptor shields at least a portion of the food product against microwave gradiation whilst simultaneously heating said portion by infrared radiation.

25. A method of packaging a food product, the method comprising the steps of:

placing a food product and a microwave susceptor in a container such that the susceptor is positioned adjacent the food product;

seating the container;

flushing the container with a gas of a controlled composition such that the gas is contained in the sealed container; and providing at least one releasably sealed opening defined by the container that is adapted to vent gas from the container during heating.

26. A method according to claim 25, in which the susceptor is positioned to cover at least the top and bottom of the food product.

27. A method according to claim 25 or claim 26 in which the food product is placed in an open-ended susceptor sleeve, and the sleeved food product is placed in the container.

28. A method according to claim 25 or claim 26, in which the container comprises a flexible wrapper.

29. A method according to claim 25 or claim 26, in which the container is sealed by heat crimping.

30. A method according to claim 25 or claim 26, in which the releasably sealed opening comprises a seam of the container.

31. A packaged food product according to claim 1, in which the releasable sealed opening is adapted to open part way through the heating process so that during a first part of the heating process the temperature and pressure of gas sealed within the container increases, and during a second part of the heating process gas and steam is released from the container.

32. A method of packaging a food product, the method comprising the steps of:

placing a food product and a microwave susceptor in a container such that the susceptor is positioned adjacent the food product;

sealing the container;

flushing the container with a gas such that the gas is contained in the sealed container; and providing at least one releasably sealed opening defined by the container that is adapted to vent gas from the container during heating, the releasably sealed opening being of a sufficient size to release substantially all of the gas upon the releasably sealed opening venting during heating.

* * * * *